United States Patent [19]

van Kuijk

[11] Patent Number: 5,075,931

[45] Date of Patent: Dec. 31, 1991

[54] PORTABLE UNIT WITH UNIVERSAL CLIP

[75] Inventor: Eric van Kuijk, Delft, Netherlands

[73] Assignee: Ericsson Radio Systems B.V., Va Emmen, Netherlands

[21] Appl. No.: 687,679

[22] Filed: Apr. 19, 1991

[30] Foreign Application Priority Data

Apr. 23, 1990 [NL] Netherlands ..... 9000966

[51] Int. Cl.[5] ..... A45F 5/00

[52] U.S. Cl. ..... 24/3 J; 24/3 R; 224/252

[58] Field of Search ..... 24/3 J, 3 R, 3 H, 6, 24/67.7, 510, 458; 224/241, 252, 269; 16/380

[56] References Cited

U.S. PATENT DOCUMENTS

| | | | |
|---|---|---|---|
| 744,582 | 11/1903 | Martin | 24/3 H |
| 1,338,702 | 5/1920 | Schrantz . | |
| 1,520,043 | 12/1924 | White . | |
| 3,237,326 | 3/1966 | Naffin | 40/1.5 |
| 4,536,925 | 8/1985 | Boothe et al. | 24/3 J |
| 4,780,934 | 11/1988 | Vickers et al. | 24/3 J |
| 4,828,153 | 5/1989 | Guzik et al. | 224/252 |
| 4,881,150 | 11/1989 | Oyamada | 24/3 J |

FOREIGN PATENT DOCUMENTS

| | | |
|---|---|---|
| 212154 | 5/1923 | United Kingdom . |
| 2199886 | 7/1988 | United Kingdom . |

OTHER PUBLICATIONS

Search report from The Netherlands dated Jan. 9, 1991.
Standard Search Report dated Jan. 9, 1991.

*Primary Examiner*—Victor N. Sakran
*Attorney, Agent, or Firm*—Burns, Doane, Swecker & Mathis

[57] ABSTRACT

Portable unit, comprising a housing, a clip piece fixed to the housing by a hinge, and spring means which press the clip piece against the housing for forming a clip which is suitable for being clipped over an edge of a garment. The clip piece has an essentially L-shaped part with the hinge being fitted at a distance from one leg of the L-shaped part. The axis of the hinge runs essentially parallel to said one leg of the L-shaped part and such that the one leg extends past the hinge in the longitudinal direction of said one leg.

4 Claims, 2 Drawing Sheets

PORTABLE UNIT WITH UNIVERSAL CLIP

BACKGROUND OF THE INVENTION

The invention relates to a portable unit, comprising a housing, a clip piece fixed to the housing by a hinge, and spring means which press the clip piece against the housing for forming a clip which is suitable for being clipped over an edge of a garment.

A portable unit of this kind is known in practice. The known portable unit is, for example, a paging unit of a paging system. In the case of the known unit the clip piece is essentially elongated, and the axis of the hinge runs at right angles to the lengthwise direction of the clip piece. The disadvantage of this is that the portable unit can be clipped only with the same orientation, for example in order to prevent tilting, over edges of the garment running in the same direction. If the portable unit is, for example, suitable for being clipped over a horizontal edge of a jacket pocket or of a belt, on account of its weight and the relatively low clamping force due to the elongated shape of the clip piece, the portable unit is generally not suitable for being clipped over non-horizontal edges of, for example, lapels. As a result, a user of the portable unit can be undesirably limited in the choice and use of his garments.

OBJECTS AND SUMMARY OF THE INVENTION

The object of the invention is to eliminate the disadvantages of the known portable unit.

This object is achieved according to the invention for the portable unit mentioned in the introduction in that the clip piece has an essentially L-shaped part, in that the hinge is fitted at a distance from one leg of the L-shaped part of the clip piece on the other leg, in that the axis of the hinge runs essentially parallel to the one leg, and in that the one leg extends past the hinge. When the clip piece is rotated about the hinge axis, the one leg will come away entirely from the housing, as a result of which the clip piece can be pushed over edges of a garment either running parallel to the hinge axis or running at right angles to the hinge axis, and can then be clipped on the garment.

The hinge preferably extends parallel to the one leg over at most the width of the other leg. This prevents damage to the garment by any projecting part of the hinge.

If, as known per se, the housing is essentially box-shaped and the hinge is fitted on a main face of the housing parallel to one side of the housing, that one side is preferably a long side. This means that in general the centre of gravity of the portable unit will lie in an advantageous position relative to the hinge axis, which prevents accidental tilting.

In this case the one leg is preferably longer than the other leg of the essentially L-shaped part of the clip piece. The longer leg can thereby project relatively far into a pocket or over a belt, which prevents loss. The edge of the long leg furthest away from the hinge axis is in this case also suitable for being clipped along its entire length over a non-horizontal edge of the garment, while the clip piece, as a result of the relatively short distance from the above-mentioned edge of the long leg and the hinge axis, exerts a relatively great clamping force on the garment, with the result that in such a situation loss is also effectively prevented.

BRIEF DESCRIPTION OF THE DRAWINGS

The invention is explained with reference to the drawings. In the drawings.

DETAILED DESCRIPTION OF THE PREFERRED EMBODIMENT

Figure 1:
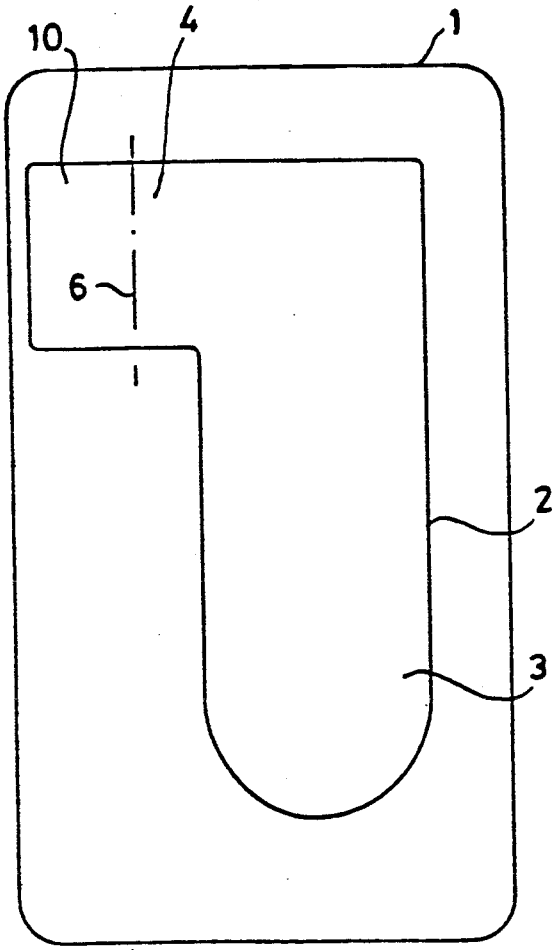
FIG. 1 shows a view of an essentially box-shaped portable unit.
Figure 2:
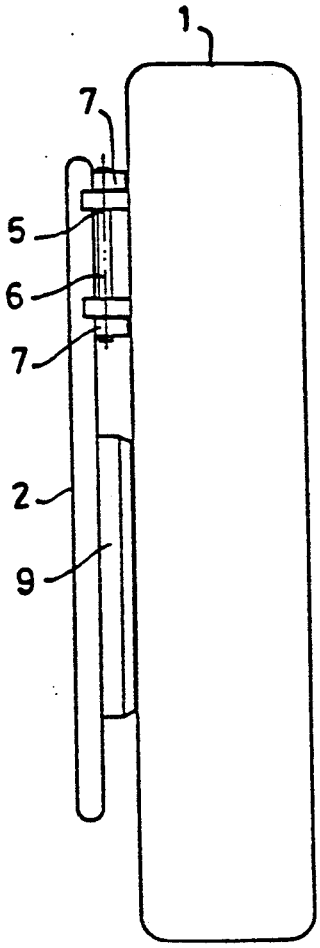
FIG. 2 shows a side view of the unit of FIG. 1.

An essentially L-shaped clip piece 2 is fitted on one side of the portable unit 1 shown in FIG. 1, which in the event of the portable unit being a paging unit is generally the rear side of the unit. When the portable unit is in the shape of an elongated box, one leg 3 of the clip piece 2 is preferably longer than the other leg 4, and the longer leg 3 preferably runs parallel to the lengthwise direction of the portable unit 1.

The clip piece 2 is fixed to the side of the portable unit 1 shown, by means of a hinge 5 with a hinge axis 6 running essentially parallel to one of the legs, leg 3 in the example shown. The clip piece 2 is forced towards the portable unit in the direction of the arrow 8 by means of a spring 7 fitted round the axis 6.

The one leg 3 has at a distance from the hinge 5, and at the same side as the hinge 5, preferably a resiliently compressible supporting element 9, which runs parallel to the hinge axis 6, which is made of, for example, rubber, and which has grooves at the side of the housing 1. The supporting element 9 contributes to the distribution of the clamping force for obtaining the best possible clamping of the clip piece 2 to a garment in the manner explained below.

Figure 3:
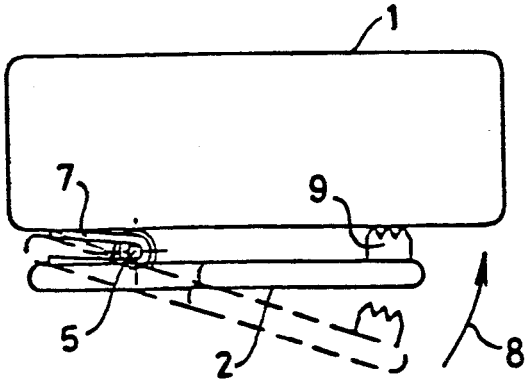
FIG. 3 shows a top view of the unit of FIG. 1.
Figure 4:
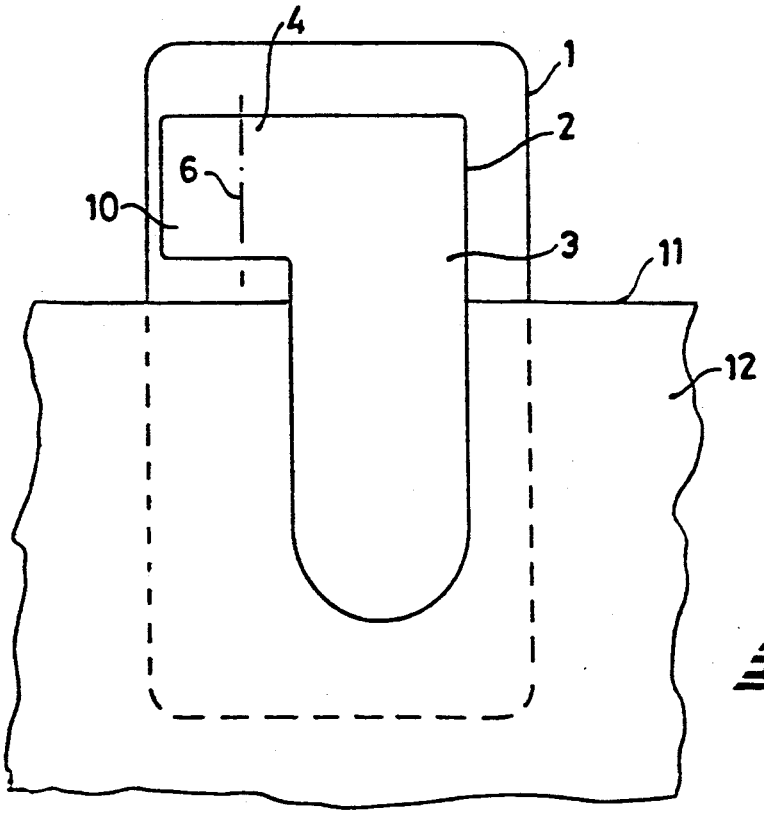
FIG. 4 shows an example of a first application of the unit of FIG. 1.
Figure 5:
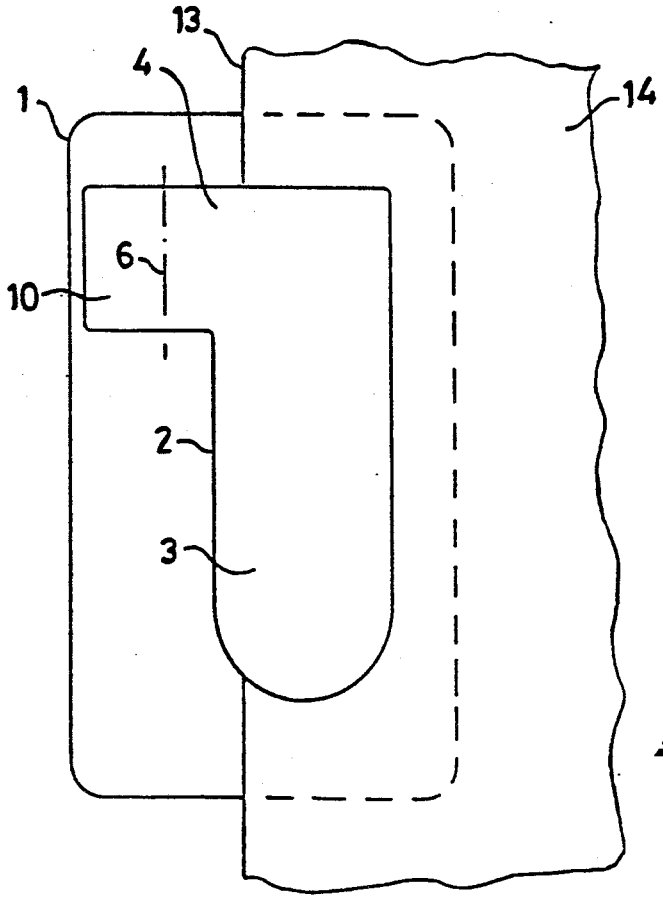
FIG. 5 shows an example of a second application of the unit of FIG. 1.

The user can turn the clip piece 2 in a direction opposite to the direction of the arrow 8 about the axis 6 by taking hold of it and moving it away from the rest of the unit 1, or by pressing on an extension 10 of the other leg 4 at the other side of the axis 6, in which case the position of the clip piece 2 shown by dashed lines in FIG. 3 is obtained In this position all of the one leg 3 is away from the housing of the portable unit 1. As a result, as shown in FIG. 4, the one leg 3 can be placed over an edge 11 of a garment, for example a pocket 12 of a jacket, running freely in a first direction, for example the horizontal direction, and firmly clipped on it. As shown in FIG. 5, the one leg 3 can, however, also be placed over an edge 13 of a garment, for example a lapel 14 of a jacket, running in another direction, and clipped. If in the latter case the one leg 3 is longer than the other leg 4, the longer leg 3 can in this case exert a relatively great clamping force on the garment 14.

It is pointed out that the clip piece 2 can be in various embodiments within the scope of the invention and can be, for example, a clamp which comprises, for example, a rigid wire running along the periphery of the clip piece 2 and the extension 10 shown in FIGS. 1 to 5.

The hinge 5 can also comprise, for example, a single element, such as a leaf spring bent in a U shape.

It is also pointed out that the invention can be used not only for paging units of a paging system, but also for portable alarm units and transponders.

What is claimed is:

1. A portable unit, comprising:

a housing;

a clip piece fixed to said housing by a hinge; and spring means for pressing said clip piece against said housing and for thereby forming a clip which is able to be clipped over an edge of a garment, wherein said clip piece has an essentially L-shaped part, wherein said hinge is fitted at a distance from one leg of said L-shaped part on an other leg of said L-shaped part, wherein an axis of said hinge extends substantially parallel to said one leg in a first direction, and wherein said one leg extends past said hinge in said first direction.

2. A portable unit according to claim 1, wherein said hinge extends substantially parallel to said one leg, over at most a width of said other leg.

3. A portable unit according to claim 1, wherein said housing is essentially box-shaped and said hinge is fitted on a main face of said housing parallel to one side of said housing, and wherein said one side is a long side of said housing.

4. A portable unit according to claim 1, wherein said one leg is longer than said other leg of said L-shaped part.

* * * * *